US009654867B2

(12) United States Patent
Litovsky et al.

(10) Patent No.: US 9,654,867 B2
(45) **Date of Patent: *May 16, 2017**

(54) ACOUSTIC DEVICE

(71) Applicant: Bose Corporation, Framingham, MA (US)

(72) Inventors: Roman N. Litovsky, Newton, MA (US); Bojan Rip, Newton, MA (US); Joseph M. Geiger, Clinton, MA (US); Chester Smith Williams, Lexington, MA (US); Pelham Norville, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/857,287

(22) Filed: Sep. 17, 2015

(65) Prior Publication Data

US 2016/0021446 A1 Jan. 21, 2016

Related U.S. Application Data

(63) Continuation-in-part of application No. 14/799,265, filed on Jul. 14, 2015, now Pat. No. 9,571,917.

(Continued)

(51) Int. Cl.
*H04R 25/00* (2006.01)
*H04R 1/34* (2006.01)

(Continued)

(52) U.S. Cl.
CPC ..... *H04R 1/347* (2013.01); *H04R 1/1091* (2013.01); *H04R 1/2857* (2013.01); *H04R 5/033* (2013.01); *H04R 2201/023* (2013.01)

(58) Field of Classification Search
CPC .... H04R 1/105; H04R 1/2853; H04R 1/2838; H04R 5/0335; H04R 1/347; H04R 1/2857;

(Continued)

(56) References Cited

U.S. PATENT DOCUMENTS

2006/0251284 A1 11/2006 Wiener
2007/0258613 A1* 11/2007 Wright ..... H04R 1/105 381/374

(Continued)

FOREIGN PATENT DOCUMENTS

GB 2517486 A 2/2015
WO 95/34184 A1 12/1995

(Continued)

OTHER PUBLICATIONS

International Search Report and Written Opinion dated Sep. 23, 2015 for PCT/US2015?040430.

(Continued)

*Primary Examiner* — Tuan D Nguyen
(74) *Attorney, Agent, or Firm* — Brian M. Dingman; Dingman IP Law, PC

(57) ABSTRACT

An acoustic device having a neck loop that is constructed and arranged to be worn around the neck. The neck loop includes housing that defines an acoustic volume, a first acoustic driver located at a first distal end of the housing and acoustically coupled to the housing, and a second acoustic driver located at a second distal end of the housing, opposite the first distal end and acoustically coupled to the housing.

22 Claims, 12 Drawing Sheets

Related U.S. Application Data

(60) Provisional application No. 62/026,237, filed on Jul. 18, 2014.

(51) Int. Cl.
*H04R 1/10* (2006.01)
*H04R 1/28* (2006.01)
*H04R 5/033* (2006.01)

(58) Field of Classification Search
CPC . H04R 1/1091; H04R 2201/023; H04R 5/033
See application file for complete search history.

(56) References Cited

U.S. PATENT DOCUMENTS

| | | | |
|---|---|---|---|
| 2007/0284184 | A1 | 12/2007 | Krueger |
| 2014/0126760 | A1 | 5/2014 | Tse et al. |

FOREIGN PATENT DOCUMENTS

| | | | |
|---|---|---|---|
| WO | 9641496 | A1 | 12/1996 |
| WO | 2016/011063 | A1 | 1/2016 |

OTHER PUBLICATIONS

The International Search Report and the Written Opinion of the International Searching Authority mailed on Jan. 2, 2017 in PCT Application No. PCT/US2016/051923.

* cited by examiner

ACOUSTIC DEVICE

CROSS-REFERENCE TO RELATED APPLICATIONS

This application is a continuation-in-part of U.S. patent application Ser. No. 14/799,265, filed on Jul. 14, 2015, which claims benefit from U.S. Provisional Patent Application No. 62/026,237, filed on Jul. 18, 2014, the entire contents of which are incorporated herein by reference.

BACKGROUND

This disclosure relates to an acoustic device.

Headsets have acoustic drivers that sit on, over or in the ear. They are thus somewhat obtrusive to wear, and can inhibit the user's ability to hear ambient sounds.

SUMMARY

All examples and features mentioned below can be combined in any technically possible way.

The present acoustic device directs high quality sound to each ear without acoustic drivers on, over or in the ears. The acoustic device is designed to be worn around the neck. The acoustic device may comprise a neck loop with a housing. The neck loop may have a "horseshoe"-like, or generally "U" shape, with two legs that sit over or near the clavicles and a curved central portion that sits behind the neck. The acoustic device may have two acoustic drivers; one on each leg of the housing. The drivers may be located below the expected locations of the ears of the user, with their acoustic axes pointed at the ears. The acoustic device may further include two waveguides within the housing, each one having an exit below an ear, close to a driver. The rear side of one driver may be acoustically coupled to the entrance to one waveguide and the rear side of the other driver may be acoustically coupled to the entrance to the other waveguide. Each waveguide may have one end with the driver that feeds it located below one ear (left or right), and the other end (the open end) located below the other ear (right or left), respectively.

The waveguides may fold over one another within the housing. The waveguides may be constructed and arranged such that the entrance and exit to each one is located at the top side of the housing. The waveguides may be constructed and arranged such that each one has a generally consistent cross-sectional area along its length. The waveguides may be constructed and arranged such that each one begins just behind one driver, runs down along the top portion of the housing in the adjacent leg of the neck loop to the end of the leg, turns down to the bottom portion of the housing and turns 180 degrees to run back up the leg, then across the central portion and back down the top portion of the other leg, to an exit located just posteriorly of the other driver. Each waveguide may flip position from the bottom to the top portion of the housing in the central portion of the neck loop.

In one aspect, an acoustic device includes a neck loop that is constructed and arranged to be worn around the neck. The neck loop includes a housing with comprises a first acoustic waveguide having a first sound outlet opening, and a second acoustic waveguide having a second sound outlet opening. There is a first open-backed acoustic driver acoustically coupled to the first waveguide and a second open-backed acoustic driver acoustically coupled to the second waveguide.

Embodiments may include one of the following features, or any combination thereof. The first and second acoustic drivers may be driven such that they radiate sound that is out of phase, over at least some of the spectrum. The first open-backed acoustic driver may be carried by the housing and have a first sound axis that is pointed generally at the expected location of one ear of the user, and the second open-backed acoustic driver may also be carried by the housing and have a second sound axis that is pointed generally at the expected location of the other ear of the user. The first sound outlet opening may be located proximate to the second acoustic driver and the second sound outlet opening may be located proximate to the first acoustic driver. Each waveguide may have one end with its corresponding acoustic driver located at one side of the head and in proximity to and below the adjacent ear, and another end that leads to its sound outlet opening, located at the other side of the head and in proximity to and below the other, adjacent ear.

Embodiments may include one of the above or the following features, or any combination thereof. The housing may have an exterior wall, and the first and second sound outlet openings may be defined in the exterior wall of the housing. The waveguides may both be defined by the exterior wall of the housing and an interior wall of the housing. The interior wall of the housing may lie along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The interior wall of the housing may be generally flat and lie under both sound outlet openings. The interior wall of the housing may comprise a raised sound diverter underneath each of the sound outlet openings. The housing may have a top that faces the ears when worn by the user, and wherein the first and sound outlet openings are defined in the top of the housing.

Embodiments may include one of the above or the following features, or any combination thereof. The housing may have a top portion that is closest to the ears when worn by the user and a bottom portion that is closest to the torso when worn by the user, and each waveguide may lie in part in the top portion of the housing and in part in the bottom portion of the housing. The neck loop may be generally "U"-shaped with a central portion and first and second leg portions that depend from the central portion and that have distal ends that are spaced apart to define an open end of the neck loop. The twist in the housing interior wall may be located in the central portion of the neck loop. The first acoustic driver may be located in the first leg portion of the neck loop and the second acoustic driver may be located in the second leg portion of the neck loop. The first waveguide may begin underneath the first acoustic driver, extend along the top portion of the housing to the distal end of the first leg portion of the neck loop and turn to the bottom portion of the housing and extend along the first leg portion into the central portion of the neck loop where it turns to the top portion of the housing and extends into the second leg portion to the first sound outlet opening. The second waveguide may begin underneath the second acoustic driver, extend along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, a first open-backed acoustic driver acoustically coupled to the first waveguide, where the first open-backed acoustic driver is carried by the housing and has a first sound axis that is pointed generally at the expected location of one ear of the user, a second open-backed acoustic driver acoustically coupled to the second waveguide, where the second open-backed acoustic driver is carried by the housing and has a second sound axis that is pointed generally at the expected location of the other ear of the user, wherein the first sound outlet opening is located proximate to the second acoustic driver and the second sound outlet opening is located proximate to the first acoustic driver, and wherein the first and second acoustic drivers are driven such that they radiate sound that is out of phase.

Embodiments may include one of the following features, or any combination thereof. The waveguides may both be defined by the exterior wall of the housing and an interior wall of the housing, and wherein the interior wall of the housing lies along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The housing may have a top portion that is closest to the ears when worn by the user and a bottom portion that is closest to the torso when worn by the user, and wherein each waveguide lies in part in the top portion of the housing and in part in the bottom portion of the housing.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, wherein the waveguides are both defined by the exterior wall of the housing and an interior wall of the housing, and wherein the interior wall of the housing lies along a longitudinal axis that is twisted 180° along its length, wherein the neck loop is generally "U"-shaped with a central portion and first and second leg portions that depend from the central portion and that have distal ends that are spaced apart to define an open end of the neck loop, wherein the twist in the housing interior wall is located in the central portion of the neck loop, wherein the housing has a top portion that is closest to the ears when worn by the user and a bottom portion that is closest to the torso when worn by the user, and wherein each waveguide lies in part in the top portion of the housing and in part in the bottom portion of the housing. There is a first open-backed acoustic driver acoustically coupled to the first waveguide, where the first open-backed acoustic driver is located in the first leg portion of the neck loop and has a first sound axis that is pointed generally at the expected location of one ear of the user. There is a second open-backed acoustic driver acoustically coupled to the second waveguide, where the second open-backed acoustic driver is located in the second leg portion of the neck loop and has a second sound axis that is pointed generally at the expected location of the other ear of the user. The first and second acoustic drivers are driven such that they radiate sound that is out of phase. The first sound outlet opening is located proximate to the second acoustic driver and the second sound outlet opening is located proximate to the first acoustic driver. The first waveguide begins underneath the first acoustic driver, extends along the top portion of the housing to the distal end of the first leg portion of the neck loop where it turns to the bottom portion of the housing and extends along the first leg portion into the central portion of the neck loop where it turns to the top portion of the housing and extends into the second leg portion to the first sound outlet opening, and the second waveguide begins underneath the second acoustic driver, extends along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

DETAILED DESCRIPTION

Figure 1:
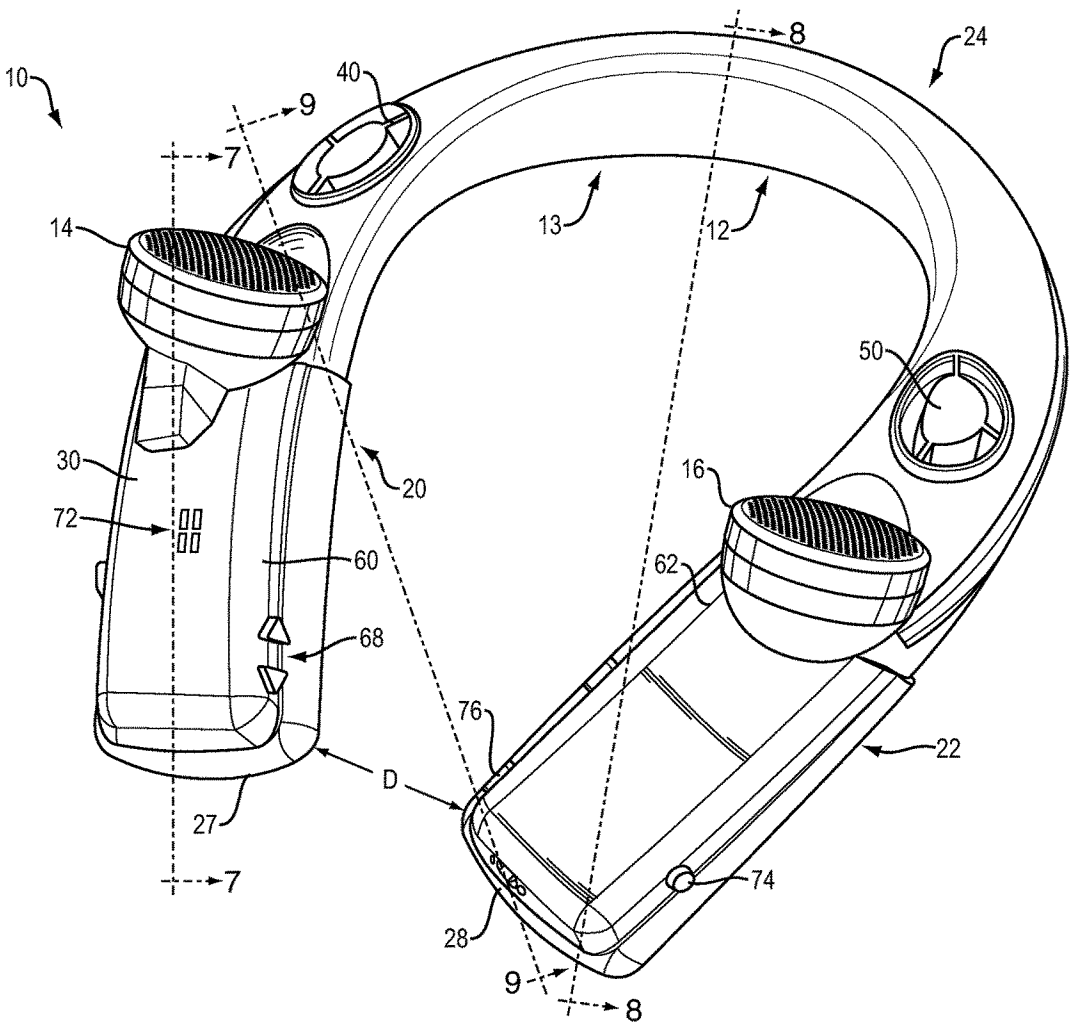
FIG. 1 is top perspective view of an acoustic device.

The acoustic device directs high quality sound to the ears without direct contact with the ears, and without blocking ambient sounds. The acoustic device is unobtrusive, and can be worn under (if the clothing is sufficiently acoustically transparent) or on top of clothing.

In one aspect, the acoustic device is constructed and arranged to be worn around the neck. The acoustic device has a neck loop that includes a housing. The neck loop has a horseshoe-like shape, with two legs that sit over the top of the torso on either side of the neck, and a curved central portion that sits behind the neck. The device has two acoustic drivers one on each leg of the housing. The drivers are located below the expected locations of the ears of the user, with their acoustic axes pointed at the ears. The acoustic device also has two waveguides within the housing, each one having an exit below an ear, close to a driver. The rear side of one driver is acoustically coupled to the entrance to one waveguide and the rear side of the other driver is acoustically coupled to the entrance to the other waveguide. Each waveguide has one end with the driver that feeds it located below one ear (left or right), and the other end (the open end) located below the other ear (right or left), respectively.

A non-limiting example of the acoustic device is shown in the drawings. This is but one of many possible examples that would illustrate the subject acoustic device. The scope of the invention is not limited by the example but rather is supported by the example.

Figure 2:
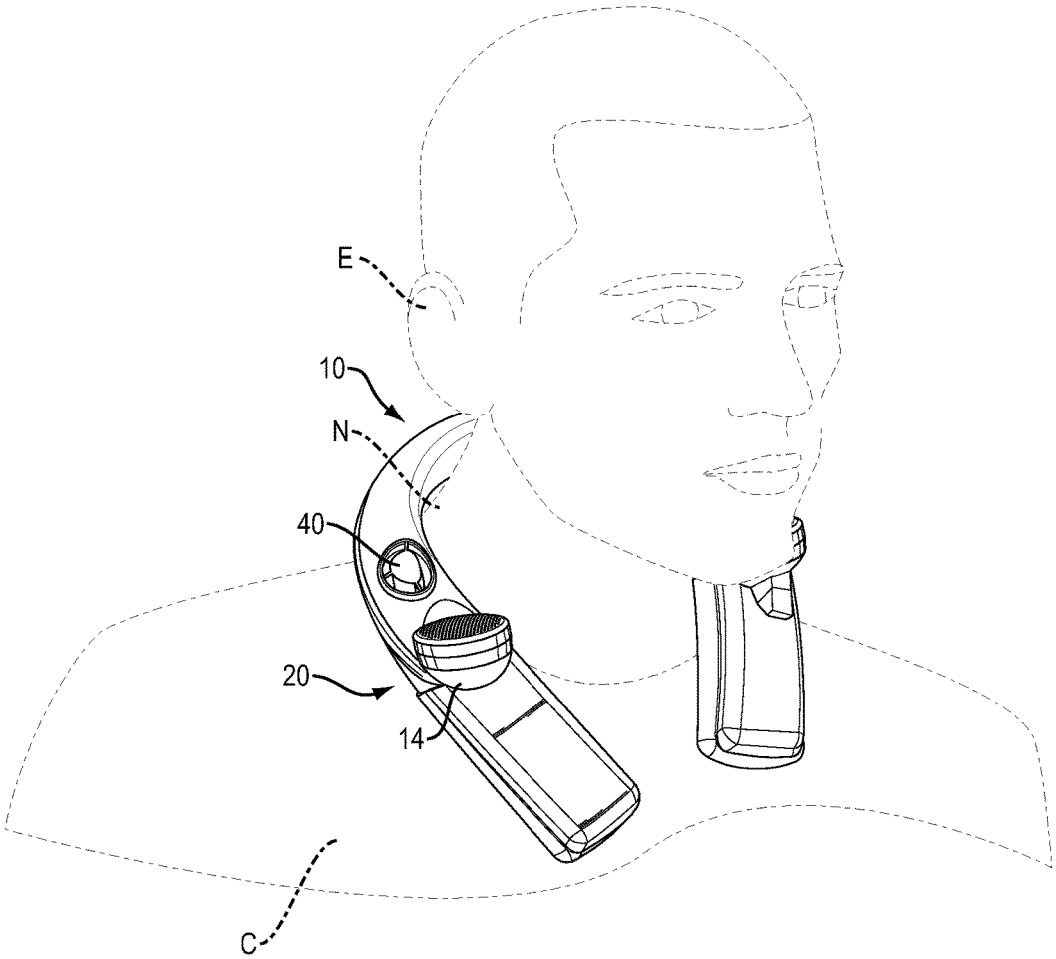
FIG. 2 is top perspective view of the acoustic device being worn by a user.
Figure 3:
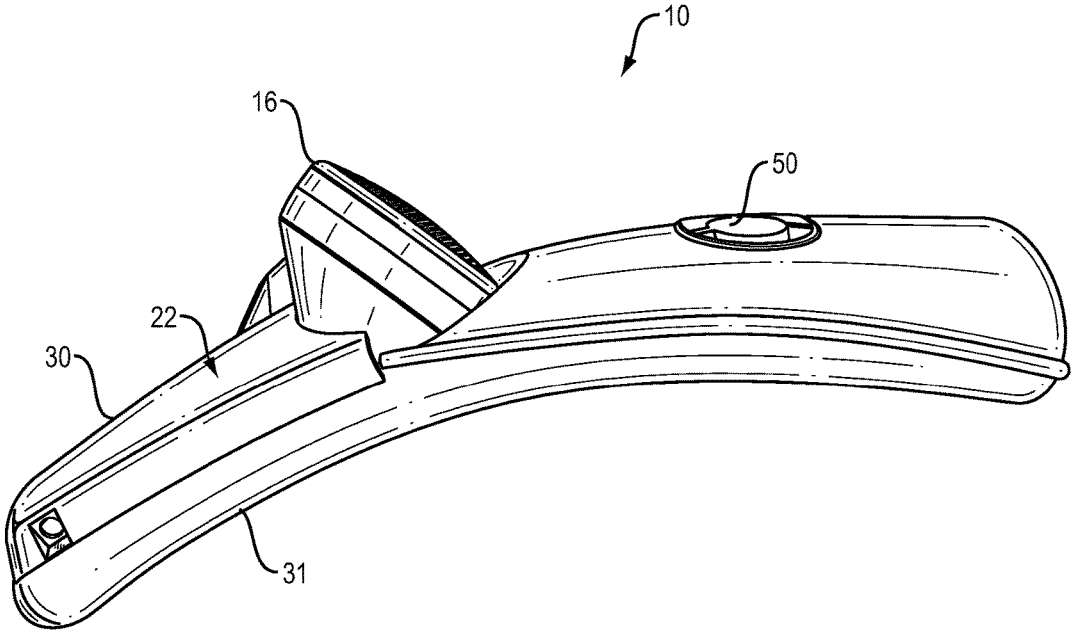
FIG. 3 is a right side view of the acoustic device.
Figure 4:
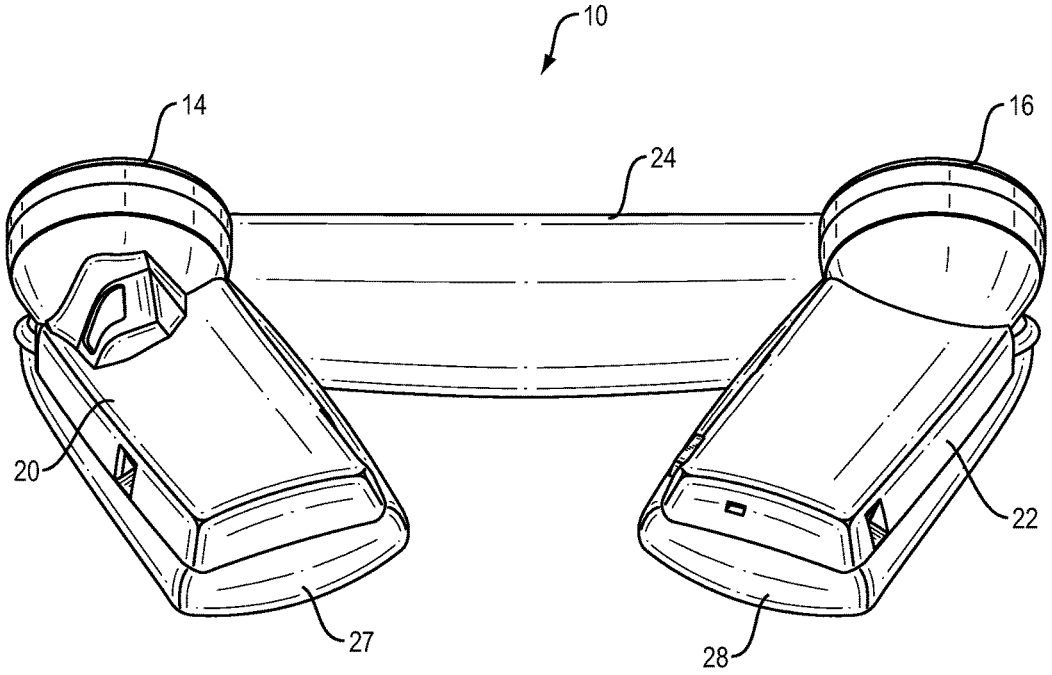
FIG. 4 is front view of the acoustic device.
Figure 5:
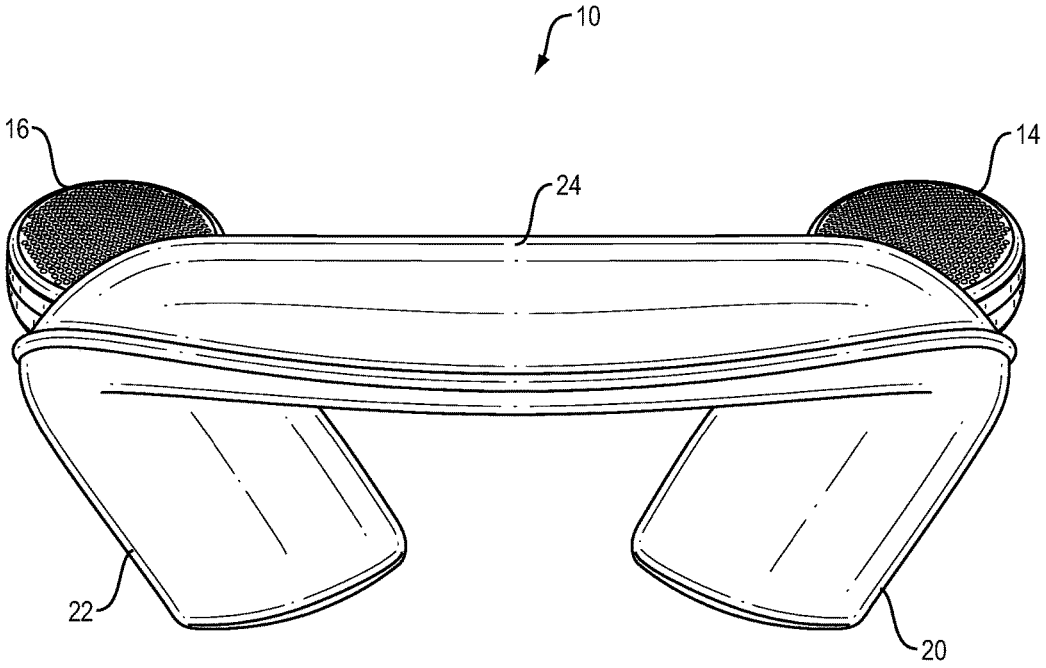
FIG. 5 is a rear view of the acoustic device.
Figure 6:
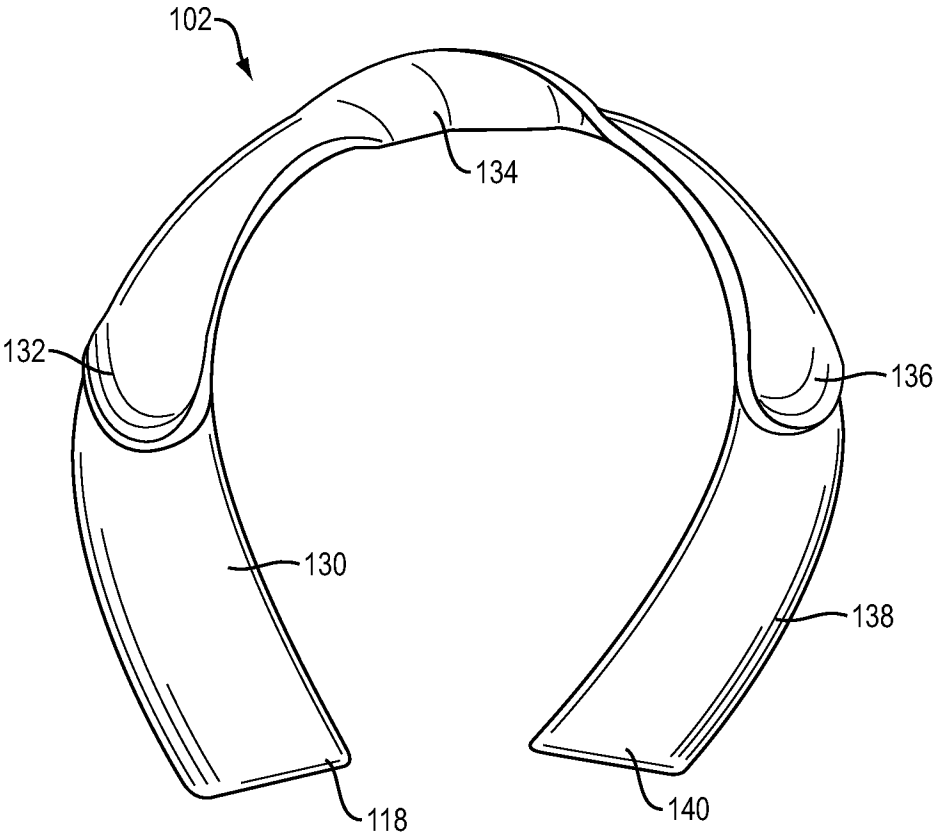
FIG. 6 is top perspective view of the interior septum or wall of the housing of the acoustic device.

Acoustic device 10 (FIGS. 1-9) includes a horseshoe-shaped (or, perhaps, generally "U"-shaped) neck loop 12 that is shaped, constructed and arranged such that it can be worn around the neck of a person, for example as shown in FIG. 2. Neck loop 12 has a curved central portion 24 that will sit at the nape of the neck "N", and right and left legs 20 and 22, respectively, that depend from central portion 24 and are constructed and arranged to drape over the upper torso on either side of the neck, generally over or near the clavicle "C." FIGS. 3-5 illustrate the overall form that helps acoustic device 10 to drape over and sit comfortably on the neck and upper chest areas.

Neck loop 12 comprises housing 13 that is in essence an elongated (solid or flexible) mostly hollow solid plastic tube (except for the sound inlet and outlet openings), with closed distal ends 27 and 28. In some examples, the housing 13 is divided internally by integral wall (septum) 102. In one non-limiting example, two internal waveguides are defined by the external walls of the housing and the septum 102. Housing 13 should be stiff enough such that the sound is not substantially degraded as it travels through the waveguides. In the present non-limiting example, where the lateral distance "D" between the ends 27 and 28 of right and left neck loop legs 20 and 22 is less than the width of a typical human neck, the neck loop also needs to be sufficiently flexible such that ends 27 and 28 can be spread apart when device 10 is donned and doffed, yet will return to its resting shape shown in the drawings. One of many possible materials that has suitable physical properties is polyurethane. Other materials could be used. Also, the device could be constructed in other manners. For example, the device housing could be made of multiple separate portions that were coupled together, for example using fasteners and/or adhesives. And, the neck loop legs do not need to be arranged such that they need to be spread apart when the device is placed behind the neck with the legs draped over the upper chest.

Housing 13 carries right and left acoustic drivers 14 and 16. The drivers are located at the top surface 30 of housing 13, and below the expected location of the ears "E." See FIG. 2. Housing 13 has lower surface 31. The drivers may be canted or angled backwards (posteriorly) as shown, as may be needed to orient the acoustic axes of the drivers (not shown in the drawings) generally at the expected locations of the ears of the wearer/user. The drivers may have their acoustic axes pointed at the expected locations of the ears. Each driver may be about 10 cm from the expected location of the nearest ear, and about 26 cm from the expected location of the other ear (this distance measured with a flexible tape running under the chin up to the most distant ear). The lateral distance between the drivers is about 15.5 cm. This arrangement results in a sound pressure level (SPL) from a driver about three times greater at the closer ear than the other ear, which helps to maintain channel separation.

Located close to and just posteriorly of the drivers and in the top exterior wall 30 of housing 13 are waveguide outlets 40 and 50. Outlet 50 is the outlet for waveguide 110 which has its entrance at the back of right-side driver 14. Outlet 40 is the outlet for waveguide 160 which has its entrance at the back of left-side driver 16. See FIGS. 7-9. Accordingly, each ear directly receives output from the front of one driver and output from the back of the other driver. If the drivers are driven out of phase, the two acoustic signals received by each ear are virtually in phase below the fundamental waveguide quarter wave resonance frequency, that in the present non-limiting example is about 130-360 Hz. This ensures that low frequency radiation from each driver and the same side corresponding waveguide outlet, are in phase and do not cancel each other. At the same time the radiation from opposite side drivers and corresponding waveguides are out of phase, thus providing far field cancellation. This reduces sound spillage from the acoustic device to others who are nearby.

Acoustic device 10 includes right and left button socks or partial housing covers 60 and 62; button socks are sleeves that can define or support aspects of the device's user interface, such as volume buttons 68, power button 74, control button 76, and openings 72 that expose the microphone. When present, the microphone allows the device to be used to conduct phone calls (like a headset). Other buttons, sliders and similar controls can be included as desired. The user interface may be configured and positioned to permit ease of operation by the user. Individual buttons may be uniquely shaped and positioned to permit identification without viewing the buttons. Electronics covers are located below the button socks. Printed circuit boards that carry the hardware that is necessary for the functionality of acoustic device 10, and a battery, are located below the covers.

Housing 13 includes two waveguides, 110 and 160. See FIGS. 7-9. Sound enters each waveguide just behind/underneath a driver, runs down the top side of the neck loop leg on which the driver is located to the end of the leg, turns 180° and down to the bottom side of the housing at the end of the leg, and then runs back up the leg along the bottom side of the housing. The waveguide continues along the bottom side of the first part of the central portion of the neck loop. The waveguide then twists such that at or close to the end of the central portion of the neck loop it is back in the top side of the housing. The waveguide ends at an outlet opening located in the top of the other leg of the neck loop, close to the other driver. The waveguides are formed by the space between the outer wall of the housing and internal integral septum or wall 102. Septum 102 (shown in FIG. 6 apart from the housing) is generally a flat integral internal housing wall that has right leg 130, left leg 138, right end 118, left end 140, and central 180° twist 134. Septum 102 also has curved angled diverters 132 and 136 that direct sound from a waveguide that is running about parallel to the housing axis, up through an outlet opening that is in the top wall of the housing above the diverter, such that the sound is directed generally toward one ear.

Figure 7:
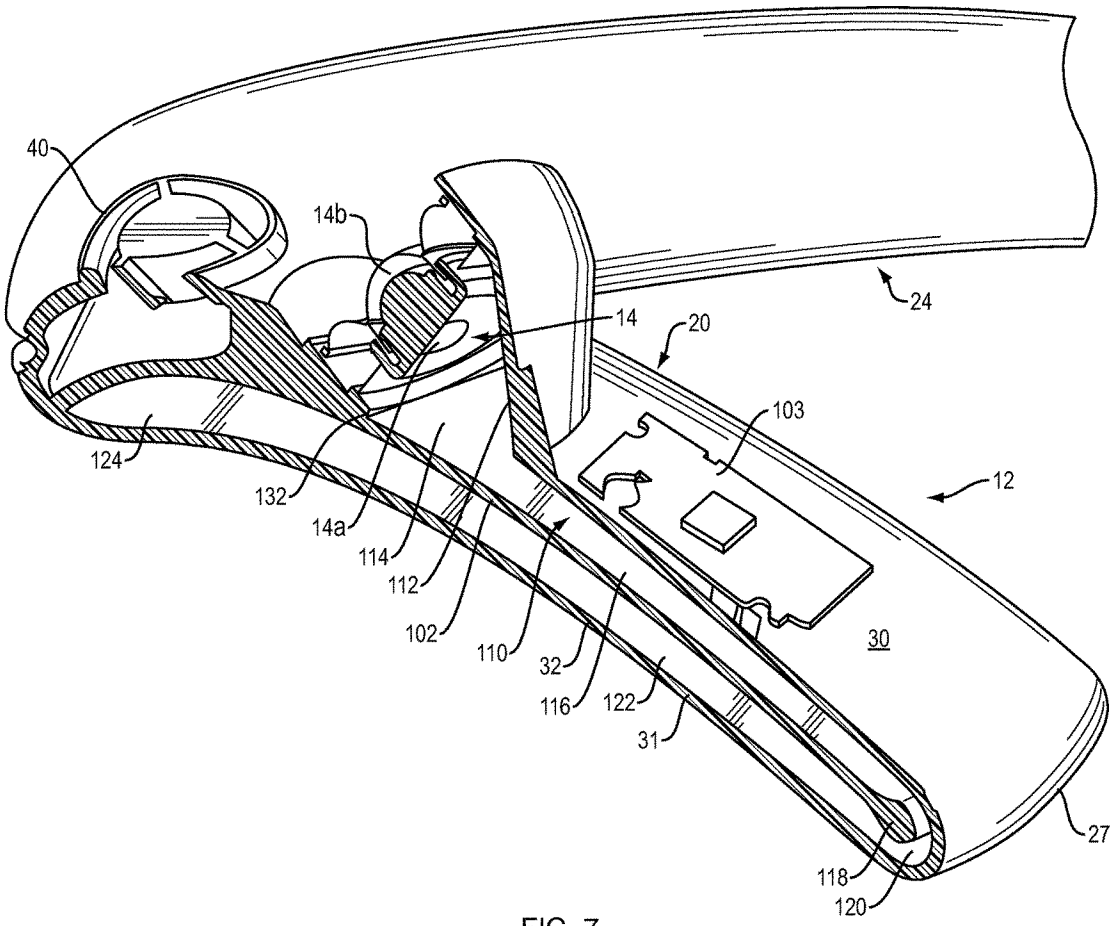
FIG. 7 is a first cross-sectional view of the acoustic device taken along line 7-7 in FIG. 1.
Figure 8:
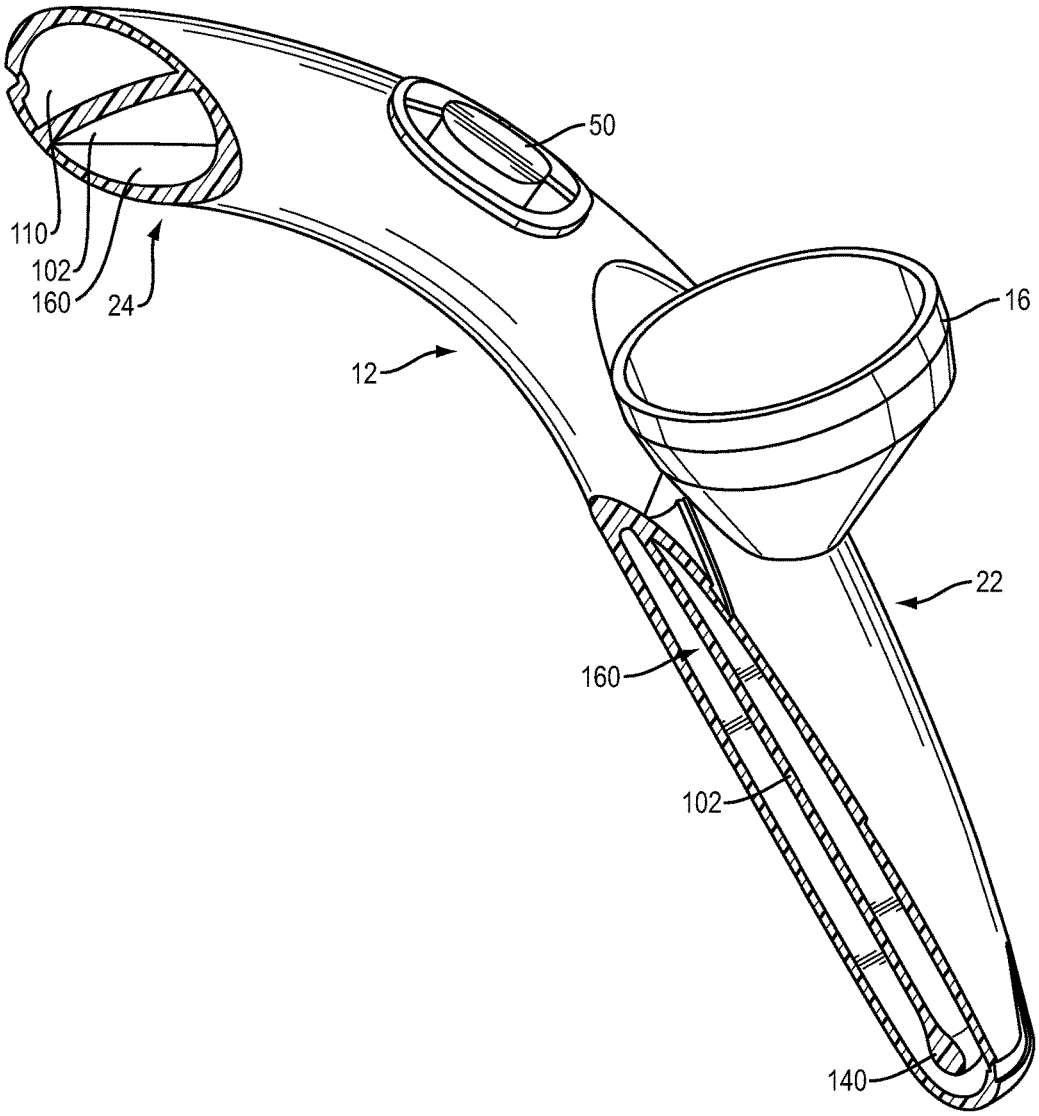
FIG. 8 is a second cross-sectional view of the acoustic device taken along line 8-8 in FIG. 1.
Figure 9:
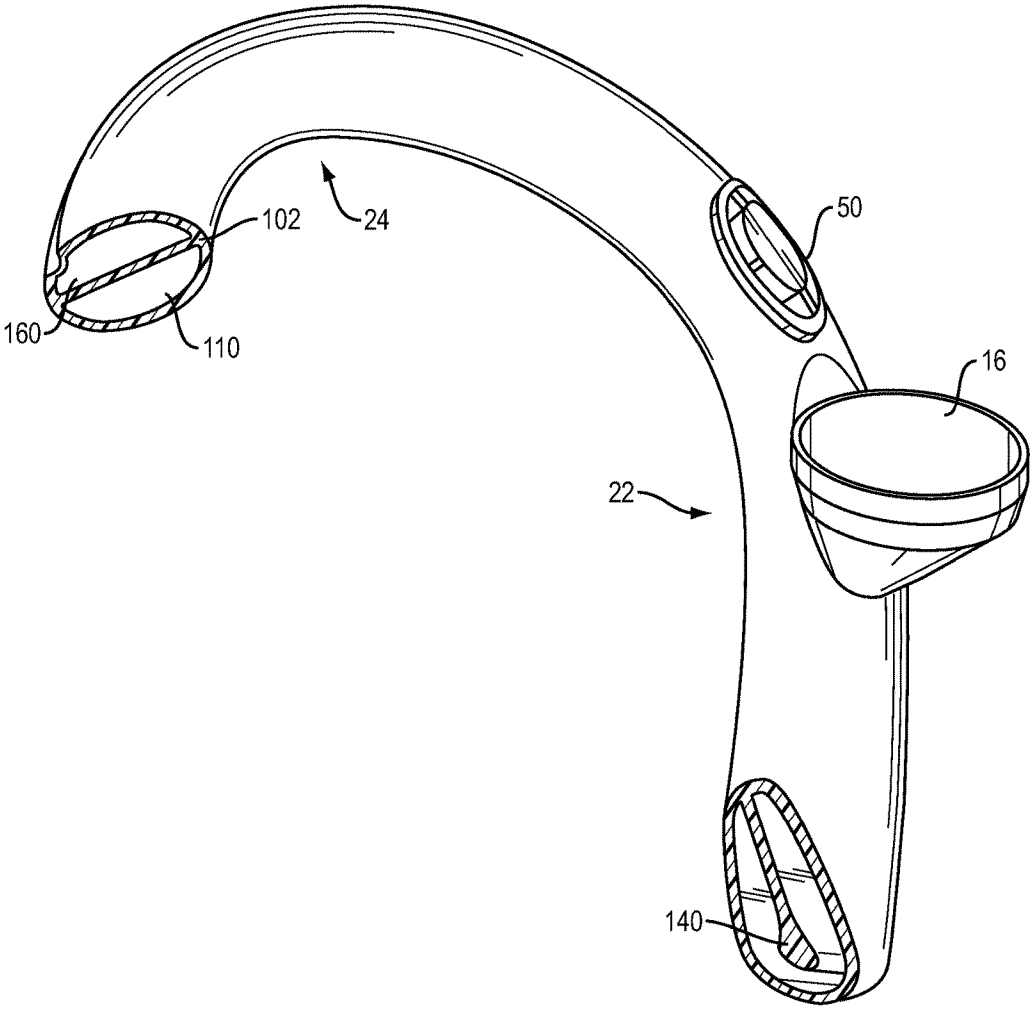
FIG. 9 is a third cross-sectional view of the acoustic device taken along line 9-9 in FIG. 1.

The first part of waveguide 110 is shown in FIG. 7. Waveguide entrance 114 is located directly behind the rear **14*a* of acoustic driver 14, which has a front side 14*b* that is pointed toward the expected location of the right ear. Downward leg 116 of waveguide 110 is located above septum 102 and below upper wall/top 30 of the housing. Turn 120 is defined between end 118 of septum 102 and closed rounded end 27 of housing 12. Waveguide 110 then continues below septum 102 in upward portion 122 of waveguide 110. Waveguide 110 then runs under diverter 133 that is part of septum 102 (see waveguide portion 124), where it turns to run into central housing portion 24. FIGS. 8 and 9 illustrate how the two identical waveguides 110 and 160 run along the central portion of the housing and within it fold or flip over each other so that each waveguide begins and ends in the top portion of the housing. This allows each waveguide to be coupled to the rear of one driver in one leg of the neck loop and have its outlet in the top of the housing in the other leg, near the other driver. FIGS. 8 and 9 also show second end 140 of septum 102, and the arrangement of waveguide 160 which begins behind driver 16, runs down the top of leg 22 where it turns to the bottom of leg 22 and runs up leg 22 into central portion 24. Waveguides 110 and 140** are essentially mirror images of each other.

In one non-limiting example, each waveguide has a generally consistent cross-sectional area along its entire length, including the generally annular outlet opening, of about 2 $cm^2$. In one non-limiting example each waveguide has an overall length in the range of about 22-44 cm; very close to 43 cm in one specific example. In one non-limiting example, the waveguides are sufficiently long to establish resonance at about 150 Hz. More generally, the main dimensions of the acoustic device (e.g., waveguide length and cross-sectional area) are dictated primarily by human ergonomics, while proper acoustic response and functionality is ensured by proper audio signal processing. Other waveguide arrangements, shapes, sizes, and lengths are contemplated within the scope of the present disclosure.

Figure 10:
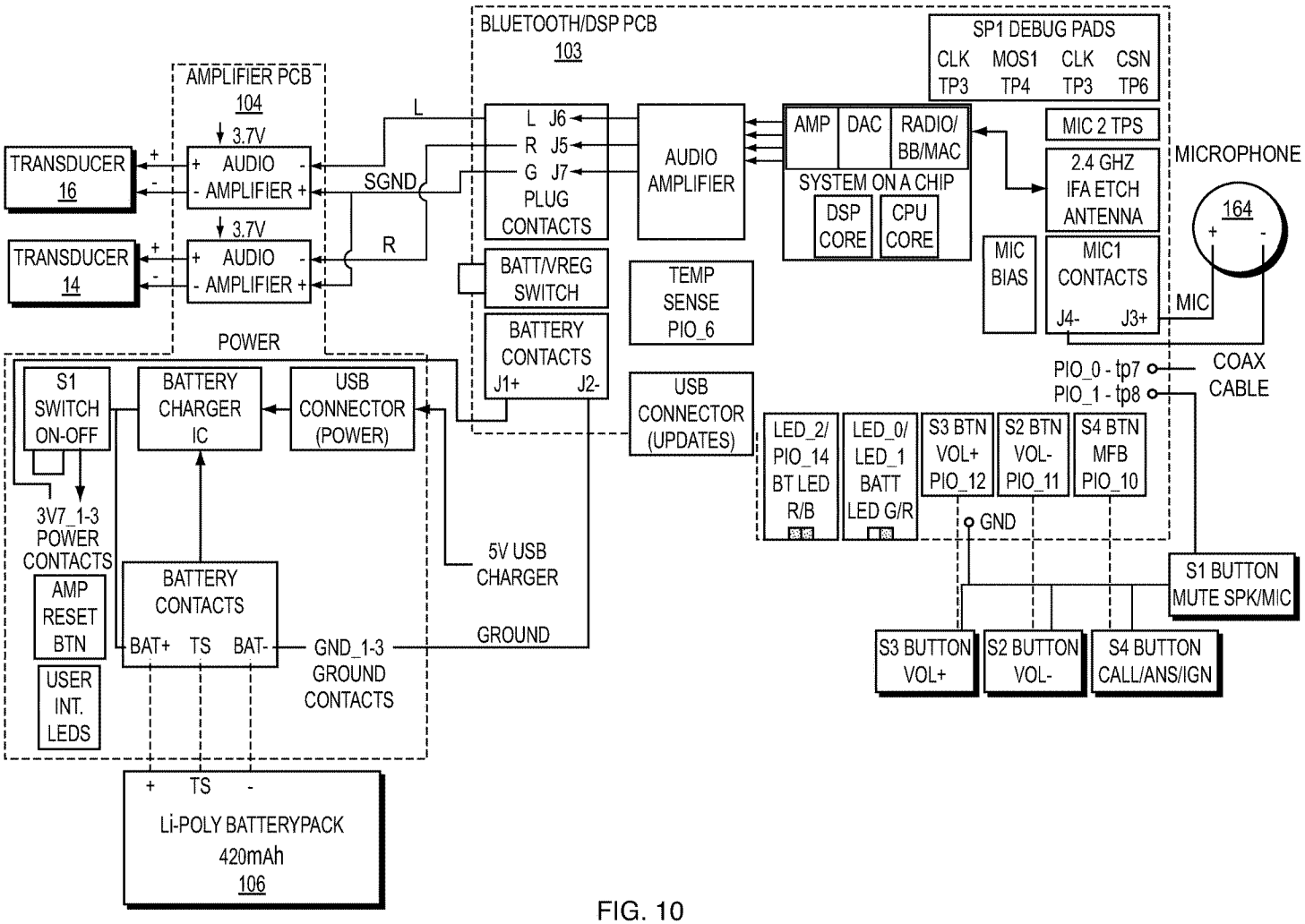
FIG. 10 is a schematic block diagram of the electronics for an acoustic device.

An exemplary but non-limiting example of the electronics for the acoustic device are shown in FIG. 10. In this example the device functions as a wireless headset that can be wirelessly coupled to a smartphone, or a different audio source. PCB 103 carries microphone 164 and mic processing. An antenna receives audio signals (e.g., music) from another device. Bluetooth wireless communication protocol (and/or other wireless protocols) are supported. The user interface can be but need not be carried as portions of both PCB 103 and PCB 104. A system-on-a-chip generates audio signals that are amplified and provided to L and R audio amplifiers on PCB 104. The amplified signals are sent to the left and right transducers (drivers) 16 and 14, which as described above are open-backed acoustic drivers. The acoustic drivers may have a diameter of 40 mm diameter, and a depth of 10 mm, but need not have these dimensions. PCB 104 also carries battery charging circuitry that interfaces with rechargeable battery 106, which supplies all the power for the acoustic device.

Figure 11:
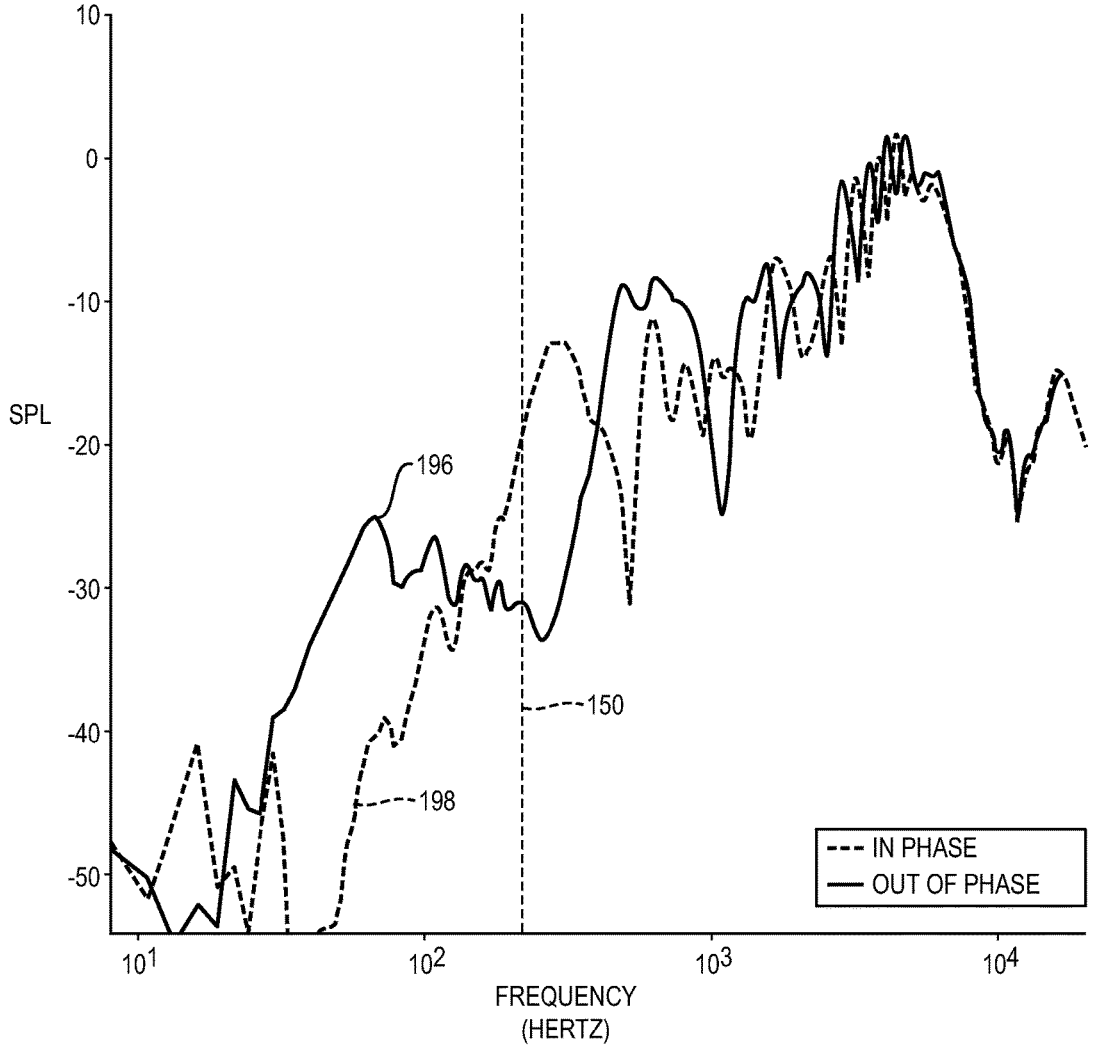
FIG. 11 is a plot of the sound pressure level at an ear of a dummy head, with the drivers of the acoustic device driven both in phase and out of phase.

FIG. 11 illustrates the SPL at one ear with the acoustic device described above. Plot 196 is with the drivers driven out of phase and plot 198 is with the drivers driven in-phase. Below about 150 Hz the out of phase SPL is higher than for in-phase driving. The benefit of out of phase driving is up to 15 dB at the lowest frequencies of 60-70 Hz. The same effect takes place in the frequency range from about 400 to about 950 Hz. In the frequency range 150-400 Hz in-phase SPL is higer than out of phase SPL; in order to obtain the best driver performance in this frequency range the phase difference between left and right channels should be flipped back to zero. In one non-limiting example the phase differences between channels are accomplished using so-called all pass filters having limited phase change slopes. These provide for gradual phase changes rather than abrupt phase changes that may have a detrimental effect on sound reproduction. This allows for the benefits of proper phase selection while assuring power efficiency of the acoustic device. Above 1 KHz, the phase differences between the left and right channels has much less influence on SPL due to the lack of correlation between channels at higher frequencies.

Figure 12A:
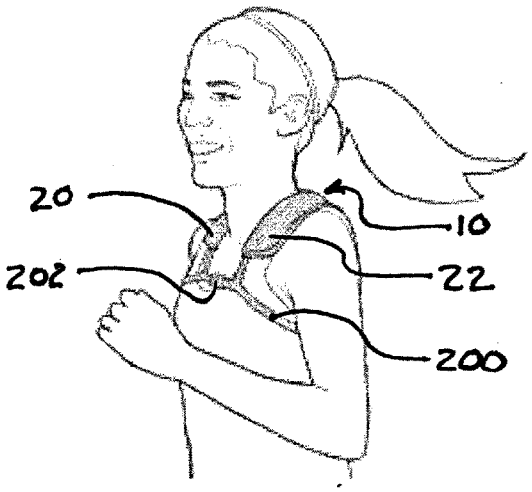
FIGS. 12A-12C is a top perspective view of an acoustic device which includes various stabilizing elements being worn by a user.
Figure 12B:
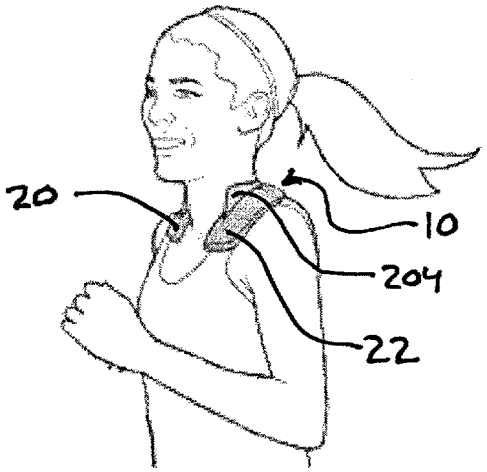
Figure 12C:
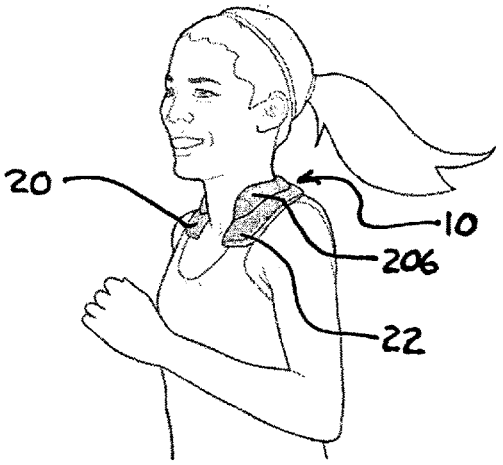

FIGS. 12A through 12C depict three non-limiting examples of the acoustic device 10 further including a stabilizing element to provide additional support and retention for the user wearing the device. The stabilizing element functions to keep the acoustic device 10 in place for use during rigorous activities such as running, jogging, skiing, mountain biking, and weight training, for example.

As described above with respect to FIGS. 1-9, the acoustic device 10 in FIGS. 12A through 12C, includes a Neck loop 12 (FIG. 1) a curved central portion 24 (FIG. 1) that will sit at the nape of the neck "N" (FIG. 2), and right and left legs 20 and 22, respectively, that depend from central portion 24 and are constructed and arranged to drape over the upper torso on either side of the neck, generally over or near the clavicle "C" (FIG. 2). The acoustic device 10 in FIGS. 12A through 12C includes one or more drivers (not shown). The drivers may be located on or below the surface of the housing of the acoustic device 10, generally within the right and left legs 20 and 22, respectively, and below the expected location of the ears "E" (FIG. 2). As previously described, the drivers may be angled to orient the acoustic axes of the drivers generally at the expected location of the ears of the user. Each driver may be about 10 cm from the expected location of the nearest ear, and about 26 cm from the expected location of the other ear (this distance measured with a flexible tape running under the chin up to the most distant ear). The lateral distance between the drivers is about 15.5 cm. The acoustic device 10 of FIGS. 12A through 12C may also waveguide outlets (not shown) located close to and just posteriorly of the drivers along the right and left legs 20 and 22, respectively.

FIG. 12A shows an acoustic device 10 including a strap 200 attached to the acoustic device 10 and releasable clasp 202 which together provide additional stability by permitting the user to releasably secure the device to the torso for use during rigorous activities. FIG. 12B shows an acoustic device 10 including a stabilizing collar 204 which is designed, sized, and configured to contact or at least partially contact the back and sides of the user's neck. The stabilizing collar 204 provides additional stability for using of the acoustic device 10 during the activities described above. FIG. 12C shows an acoustic device 10 including an inflatable chamber 206 to impart additional stability for use of the device 10 during the activities described above. The chamber 206 is designed, sized, and configured to contact the back and sides of the user's neck. In this example, the chamber 206 may be inflated with air or other suitable gas to a pressure level that provides sufficient stability and comfort for the user. The pressure level inside the chamber 206 may be adjusted to a level suitable for a particular user or for use during a particular activity. The chamber 206 can include a pressure valve (not shown) to facilitate adding or releasing air as understood by a person of ordinary skill in the art. In one non-limiting example, the chamber 206 can include multiple sub-chambers or segments to impart a predefined shape or direction of pressure against the neck of the user as the chamber is inflated.

The housing of the acoustic device 10 may include a skin or cover which surrounds a portion or all device housing. In one example, the cover includes acoustically transparent regions in those locations where the cover overlays the drivers and/or waveguide outlets in right and left legs 20 and 22, respectively, of the acoustic device 10. In some examples, the cover serves to protect the acoustic device 10 from scratches or abrasion, provide further comfort to the user while wearing the device 10, and/or may allow customization of the appearance of the device 10. The skin may be removable or permanently attached to the acoustic device 10.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device, comprising:

a neck loop that is constructed and arranged to be worn around at least a portion of a user's neck;

a retention member extending from the neck loop, the retention member being sized and configured to contact the neck or torso of the user and stabilize the acoustic device a first acoustic driver;

a second acoustic driver;

a first acoustic waveguide in the neck loop and having a first sound outlet opening; and a second acoustic waveguide in the neck loop and having a second sound outlet opening;

wherein the first acoustic driver is constructed and arranged to radiate sound into the first acoustic waveguide and outwardly from the neck loop via the first sound outlet opening, but the first acoustic driver does not radiate sound into the second acoustic waveguide;

wherein the second acoustic driver is constructed and arranged to radiate sound into the second acoustic waveguide and outwardly from the neck loop via the second sound outlet opening, but the second acoustic driver does not radiate sound into the first acoustic waveguide; and wherein the first sound outlet opening is located proximate to the second acoustic driver and the second sound outlet opening is located proximate to the first acoustic driver.

2. The acoustic device of claim 1 wherein the first and second acoustic drivers are driven such that they radiate sound that is out of phase.

3. The acoustic device of claim 1 wherein the first acoustic driver is recessed within the housing and has a first sound axis that is pointed generally at the expected location of one ear of the user, and the second acoustic driver is recessed within the housing and has a second sound axis that is pointed generally at the expected location of the other ear of the user.

4. The acoustic device of claim 1 wherein the first sound outlet opening is located proximate to the second acoustic driver and the second sound outlet opening is located proximate to the first acoustic driver.

5. The acoustic device of claim 4 wherein each waveguide has one end with its corresponding acoustic driver located at one side of the head and in proximity to and below the adjacent ear, and another end that leads to its sound outlet opening, located at the other side of the head and in proximity to and below the other, adjacent ear.

6. The acoustic device of claim 1 wherein the housing has an exterior wall, the first sound outlet opening is defined in the exterior wall of the housing, and the second sound outlet opening is defined in the exterior wall of the housing.

7. The acoustic device of claim 6 wherein the waveguides are both defined by the exterior wall of the housing and an interior wall of the housing.

8. The acoustic device of claim 7 wherein the interior wall of the housing lies along a longitudinal axis that is twisted 180° along its length.

9. The acoustic device of claim 8 wherein the neck loop is generally "U"-shaped with a central portion and first and second leg portions that depend from the central portion and that have distal ends that are spaced apart to define an open end of the neck loop, wherein the twist in the housing interior wall is located in the central portion of the neck loop.

10. The acoustic device of claim 9 wherein the interior wall of the housing is generally flat and lies under both sound outlet openings.

11. The acoustic device of claim 10 wherein the interior wall of the housing comprises a raised sound diverter underneath each of the sound outlet openings.

12. The acoustic device of claim 6 wherein the housing has a top that faces the ears when worn by the user, and wherein the first sound outlet opening is defined in the top of the housing and the second sound outlet opening is defined in the top of the housing.

13. The acoustic device of claim 1 wherein the housing has a top portion that is closest to the ears when worn by the user and a bottom portion that is closest to the torso when worn by the user, and wherein each waveguide lies in part in the top portion of the housing and in part in the bottom portion of the housing.

14. The acoustic device of claim 13 wherein the neck loop is generally "U"-shaped with a central portion and first and second leg portions that depend from the central portion and that have distal ends that are spaced apart to define an open end of the neck loop, wherein the waveguides are both defined by the exterior wall of the housing and an interior wall of the housing, wherein the interior wall of the housing lies along a longitudinal axis that is twisted along its length, and wherein the twist in the housing interior wall is located in the central portion of the neck loop;

wherein the first acoustic driver is located in the first leg portion of the neck loop and the second acoustic driver is located in the second leg portion of the neck loop;

wherein the first waveguide begins underneath the first acoustic driver, extends along the top portion of the housing to the distal end of the first leg portion of the neck loop where it turns to the bottom portion of the housing and extends along the first leg portion into the central portion of the neck loop where it turns to the top portion of the housing and extends into the second leg portion to the first sound outlet opening; and wherein the second waveguide begins underneath the second acoustic driver, extends along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

15. The acoustic device of claim 1, wherein the first acoustic driver is located proximate a first distal end of the housing.

16. The acoustic device of claim 15, wherein the second acoustic driver is located proximate a second distal end of the housing.

17. The acoustic device of claim 1, wherein the neck loop has a central portion, and first and second leg portions that depend from the central portion and that have distal ends that are spaced apart, to define an open end of the neck loop, wherein the first acoustic driver is located in the first leg portion and the second acoustic driver is located in the second leg portion.

18. An acoustic device, comprising:

a neck loop that is constructed and arranged to be worn around at least a portion of the neck of a user, the neck loop comprising a housing that comprises a first acoustic waveguide having a first sound outlet opening, and a second acoustic waveguide having a second sound outlet opening;

a first open-backed acoustic driver acoustically coupled to the first waveguide, wherein the first acoustic driver is configured to radiate sound into the first waveguide but not into the second waveguide;

a second open-backed acoustic driver acoustically coupled to the second waveguide, wherein the second acoustic driver is configured to radiate sound into the second waveguide but not into the first waveguide; and a retention member extending from the housing of the neck loop, the retention member being sized and configured to contact the neck or torso of the user and stabilize the acoustic device;

wherein the first sound outlet opening is located proximate to the second acoustic driver and the second sound outlet opening is located proximate to the first acoustic driver; and wherein the first and second acoustic drivers are driven such that they radiate sound that is out of phase.

19. The acoustic device of claim 18 wherein the waveguides are both defined by the exterior wall of the housing and an interior wall of the housing, and wherein the interior wall of the housing lies along a longitudinal axis that is twisted along its length.

20. The acoustic device of claim 19 wherein the neck loop is generally "U"-shaped with a central portion and first and second leg portions that depend from the central portion and that have distal ends that are spaced apart to define an open end of the neck loop, wherein the twist in the housing interior wall is located in the central portion of the neck loop.

21. The acoustic device of claim 20 wherein the housing has a top portion that is closest to the ears when worn by the user and a bottom portion that is closest to the torso when worn by the user, and wherein each waveguide lies in part in the top portion of the housing and in part in the bottom portion of the housing.

22. An acoustic device, comprising:

a neck loop that is constructed and arranged to be worn around the neck, the neck loop comprising a housing that comprises a first acoustic waveguide having a first sound outlet opening, and a second acoustic waveguide having a second sound outlet opening, wherein the neck loop is generally "U"-shaped with a central portion and first and second leg portions that depend from the central portion and that have distal ends that are spaced apart to define an open end of the neck loop, the neck loop further comprising a retention member sized and configured to contact the neck or torso of the user and stabilize the acoustic device;

a first open-backed acoustic driver acoustically coupled to the first waveguide, where the first open-backed acoustic driver is located in the first leg portion of the neck loop;

a second open-backed acoustic driver acoustically coupled to the second waveguide, where the second open-backed acoustic driver is located in the second leg portion of the neck loop;

wherein the first and second acoustic drivers are driven such that they radiate sound that is out of phase; and wherein the first sound outlet opening is located proximate to the second acoustic driver and the second sound outlet opening is located proximate to the first acoustic driver.

* * * * *